US007461458B2

(12) United States Patent
Peyser et al.

(10) Patent No.: US 7,461,458 B2
(45) Date of Patent: Dec. 9, 2008

(54) WET SHAVING RAZOR

(75) Inventors: Mark Peyser, Easton, CT (US); Paul Skibo, Naugatuck, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 189 days.

(21) Appl. No.: 11/453,751

(22) Filed: Jun. 14, 2006

(65) Prior Publication Data

US 2007/0289139 A1 Dec. 20, 2007

(51) Int. Cl.
*B26B 21/52* (2006.01)

(52) U.S. Cl. ..... 30/532; 30/50; 30/527

(58) Field of Classification Search ..... 30/47, 30/50, 57, 526, 527, 530, 532
See application file for complete search history.

(56) References Cited

U.S. PATENT DOCUMENTS 4,026,016 A 5/1977 Nissen
4,587,730 A * 5/1986 Iten ..... 30/541
4,996,772 A * 3/1991 Iten ..... 30/41
5,893,213 A 4/1999 Motta
6,112,412 A 9/2000 Richard
6,122,826 A * 9/2000 Coffin et al. ..... 30/57
6,138,361 A 10/2000 Richard et al.
6,311,400 B1 * 11/2001 Hawes et al. ..... 30/527
6,421,925 B1 * 7/2002 Wonderley ..... 30/532
6,854,188 B1 2/2005 Wonderley
7,200,942 B2 * 4/2007 Richard ..... 30/526

OTHER PUBLICATIONS

International Search Report for PCT/US2007/013858, dated Nov. 15, 2007.

* cited by examiner

*Primary Examiner*—Hwei-Siu C Payer
(74) *Attorney, Agent, or Firm*—Michaud-Duffy Group LLP

(57) ABSTRACT

A wet shaving razor has a handle, a razor cartridge pivotally mounted to the handle and a protective cover. The handle may be a unitary molding or an assembly including a pivot frame. The handle has a biasing member and a creep control arm that controls creep in the biasing member. The creep control arm interacts with the protective cover to provide a first at-rest position for the cartridge. The biasing member interacts with the cartridge to provide a second at-rest position when the protective cover is removed from the razor. The first at-rest position may be generally identical to the second at-rest position or may be different.

4 Claims, 7 Drawing Sheets

WET SHAVING RAZOR

BACKGROUND

1. Field of the Invention

This invention relates generally to shaving devices, and more specifically to handles for wet shaving razors having biasing members and means to control creep in the biasing members.

2. Background Information

In recognition that skin surfaces to be shaved are not planar, some modern shaving implements, commonly known as disposable safety or wet shaving razors, have a handle and a pivotally connected razor cartridge that are intended to be permanently coupled and disposed of as a single unit. Other wet shaving razors include a disposable razor cartridge releasably connected to a reusable handle. The cartridge comprises a housing having at least one razor blade with a sharpened cutting edge disposed therein. During use, the razor cartridge can pivot relative to the handle about a pivot axis between a neutral, or at-rest, position and a rotated position. The handle is customarily provided with a biasing member that interacts with the razor cartridge to provide an at-rest position and to permit resilient pivotal movement of the razor cartridge away from the at-rest position in response to forces encountered during shaving. The bias force provided by the biasing member prevents chatter of the cartridge in use but is not so great to restrict or limit pivotal movement of the cartridge in response to the forces encountered during shaving.

The assignees of the present application successfully manufacture and sell a disposable wet shaving razor under the trademark XTREME3™. The XTREME3™ razor includes a handle assembly with a razor cartridge pivotally mounted thereon and a protective cap or cover that at least protects the cutting edges of the razor blades from accidental damage during transit. The XTREME3™ handle assembly and cartridge are generally disclosed in several U.S. patents to Richard et al including U.S. Pat. No. 6,138,361, essential matter of which is incorporated herein for reference. The XTREME3™ protective cap is generally disclosed in U.S. Pat. No. 5,893,213 to Motta, essential matter of which is incorporated herein for reference. The handle assembly of the XTREME3™ razor having reference numeral 94 in the '361 patent includes a pivot frame having reference numeral 103 therein. The handle assembly comprises three components: an upper and a lower housing permanently joined together and having the pivot frame permanently disposed therewithin. The pivot frame is manufactured by injection molding and comprises the thermoplastic material commonly known as acetal or more correctly polyoxymethylene or POM. POM is a so-called engineering grade thermoplastic and has excellent creep resistance characteristics. Creep is a commonly understood phenomenon that describes a permanent change of shape of a structure as a result of exposure to one or both of prolonged stress or prolonged elevated temperatures.

For at least manufacturing reasons it would be advantageous for the assignees of the present application to be able to manufacture at least a pivot frame or more preferably a unitary handle for a wet shaving razor from a commodity thermoplastic polymer such as polypropylene. Polypropylene offers many advantages including the ability to be chemically bonded to certain thermoplastic elastomer (TPE) materials. This ability enables the manufacturer to provide components having for instance a soft grip with relative ease by utilizing a two-shot or two-color injection molding process. In this process a relatively rigid polypropylene substrate can be provided with a whole or partial TPE skin having the desired soft grip characteristics. The TPE chemically bonds to the polypropylene at the interface between the two materials and generally no other attachment means are required. Unfortunately, commodity thermoplastic materials such as polypropylene have less desirable creep resistance characteristics than POM.

The object of the present invention is to provide, for manufacturing advantages, a wet shaving razor or component part thereof, manufactured from a commodity thermoplastic polymer and having means to control creep.

SUMMARY

In one aspect, an embodiment of the invention features, in general a pivot frame for a wet shaving razor. The pivot frame includes pivoting connecting structure that can be a bifurcated leaf spring, a biasing member and a creep control arm, a portion of which can be adjacent the biasing member. The pivoting connecting structure can comprise shell bearings, axles or other well known means.

In a further aspect, another embodiment of the invention features, in general a handle for a wet shaving razor. The handle can be a unitary molding or an assembly including a pivot frame as described above. The handle includes pivoting connecting structure, a biasing member and a creep control arm as described above.

In a still further aspect, another embodiment of the invention features, in general, a wet shaving razor. The razor includes a handle as described above, a razor cartridge and a protective cover. The handle has pivoting connecting structure, a creep control arm, and a biasing member. The razor cartridge is pivotally mounted to the pivoting connecting structure. The protective cover is mounted to the cartridge. The creep control arm acts upon the protective cover to provide a first pivotal at-rest position of the cartridge relative to the handle. The biasing member acts upon the cartridge to provide a second pivotal at-rest position of the cartridge relative to the handle when the protective cover is removed. The first at-rest position may be generally identical to the second at-rest position or may be different.

Use of one or more creep control arms described herein enable a manufacturer to utilize a thermoplastic material having less desirable creep resistance characteristics than POM. This provides manufacturing advantages without substantially affecting the desired resilient pivotal movement of a razor cartridge relative to a handle.

The above features and advantages of the present invention will be more fully understood with reference to the following detailed description when taken in conjunction with the accompanying drawings.

DETAILED DESCRIPTION OF THE INVENTION

Figure 1:
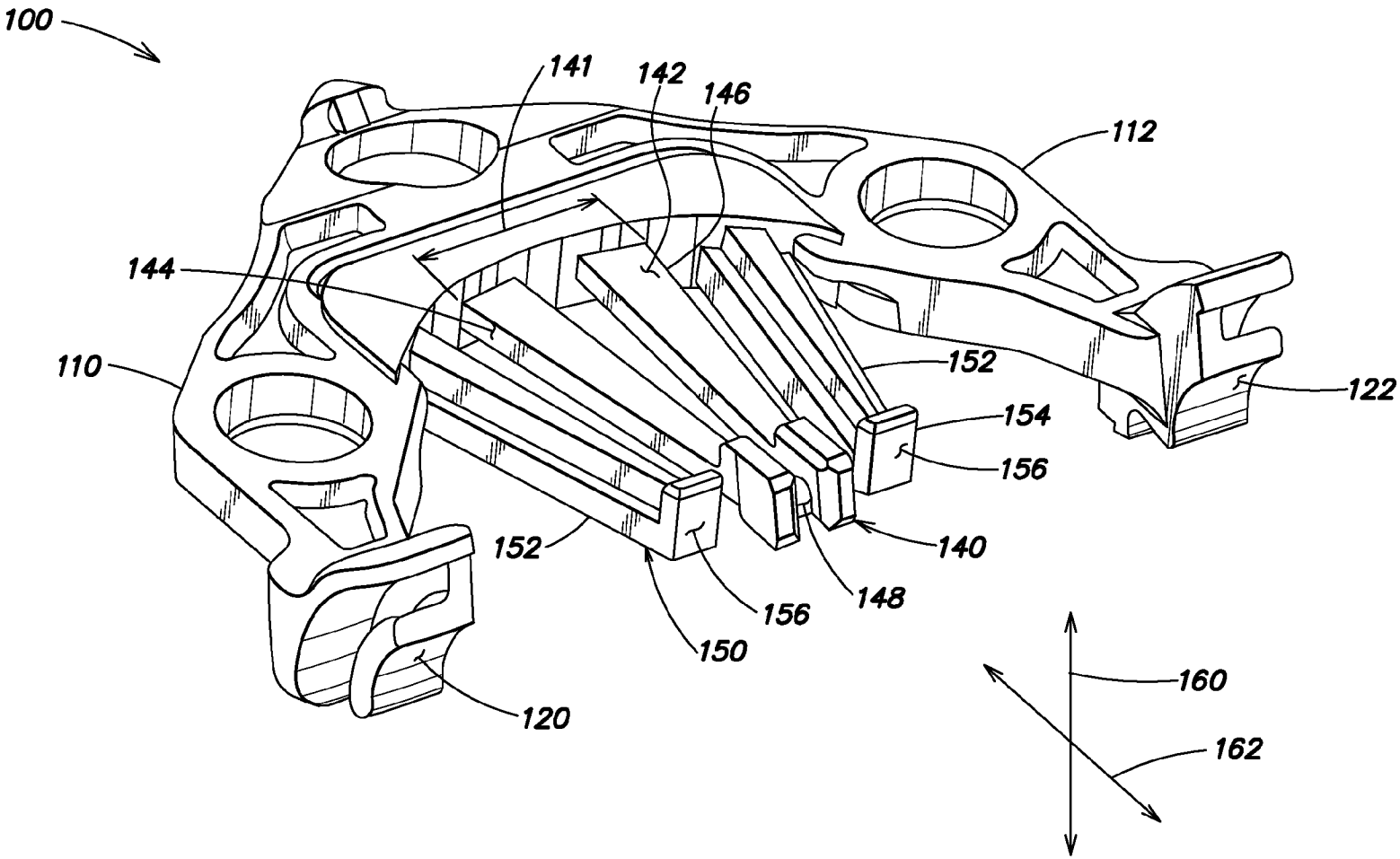
FIG. 1 is an isometric view from above of a first embodiment of a pivot frame of the present invention.
Figure 2:
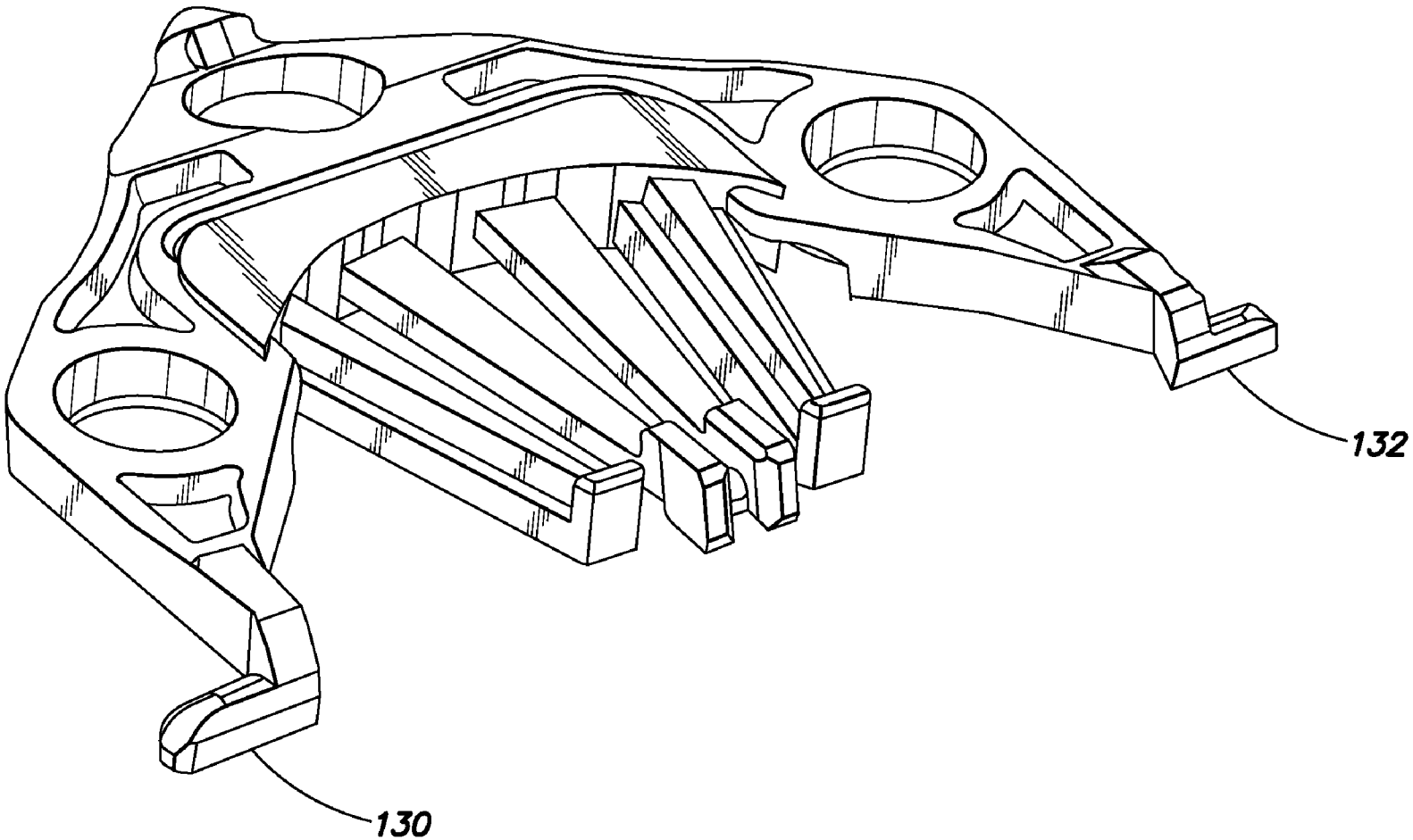
FIG. 2 is an isometric view from above of a second embodiment of a pivot frame of the present invention.

Referring now to the drawings and in particular FIGS. 1-2, a pivot frame 100 for a safety razor assembly is shown. The pivot frame 100 is preferably a unitary injection molded component comprising a commodity thermoplastic, preferably polypropylene and most preferably the grade designated AP5135-HS manufactured by the HUNTSMAN CO. This particular material is selected based on a balance of several preferred characteristics including injection molding process characteristics or moldability and frictional properties relative to any other component in dynamic contact thereto during shaving. One of skill in the art will understand that other materials may be utilized and the present invention is not limited in this regard. The pivot frame comprises a pair of spaced apart arms 110, 112 each having pivoting connecting structure at the outer portion thereof. The embodiment of FIG. 1 depicts pivoting connecting structure comprising shell bearings 120, 122 respectively. The embodiment of FIG. 2 depicts pivoting connecting structure comprising axles 130, 132 respectively. In the embodiment depicted the axles extend in an outward direction from each arm. The axles can alternatively extend in an inward direction from the arms. One of skill in the art will further understand that other pivoting connecting structure may be utilized and the present invention is not limited in this regard. The pivot frame has a biasing member 140 that is preferably a leaf spring that can be bifurcated, having an elongated portion 142 with first and second outer side surfaces 144, 146 and a cam surface 148 at the outer portion thereof. The elongated portion of the biasing member has a generally flat cross section of approximate dimensions 8.0 mm wide×1.0 mm thick at its root, however a root width dimension 141 generally less than about 15.0 mm can also provide adequate performance. The bifurcation slot is about 2.0 mm wide at the root end of the elongated portion of the biasing member. One of skill in the art will understand that other shapes and dimensions may be utilized for the biasing member. In use, as described later in the present application, the leaf spring preferably flexes in a plane substantially parallel to arrow 160. One of skill in the art will understand additional modes of deflection of the biasing member such as torsion, flexing in a plane 162 generally perpendicular to 160 and combinations thereof may be used and the present application is not limited in this regard. The biasing member can also comprises a sprung plunger as is well known in the art and is disclosed in at least U.S. Pat. No. 4,026,016 to Nissen, essential matter of which is incorporated herein for reference. The pivot frame has at least one creep control arm 150. In the embodiments depicted, a pair of creep control arms is disposed on either side of the biasing member but the present invention is not limited in regard to the quantity or position of the creep control arms. The creep control arm has an elongated portion 152 and preferably has a foot 154 extending generally perpendicular to the elongated portion. The creep control arm has a terminating surface 156 at the outer end thereof. For reasons described later in the present application the creep control arm is substantially rigid at least in the plane 160. The creep control arm is preferably "T" shaped in cross section along at least a portion of its length. The "T" has approximate dimensions at its root of: (for the horizontal part of the "T") 3.0 mm wide×1.5 mm deep and (for the vertical part of the "T") 2.0 mm deep×1.0 mm wide. The creep control arm preferably tapers along its length thereby reducing some or all of these dimensions. One of skill in the art will understand that the overall depth of the creep control arm provides a major contributing factor to the overall stiffness of the arm. The total root depth dimension 151 (shown in FIG. 7) of the "T" cross section is 4.5 mm, however, depths up to about 6.0 mm can also provide adequate performance. One of skill in the art will also understand that other cross sections such as "I", "+", "I" or "L" can be used and the present invention is not limited in this regard.

Figure 3:
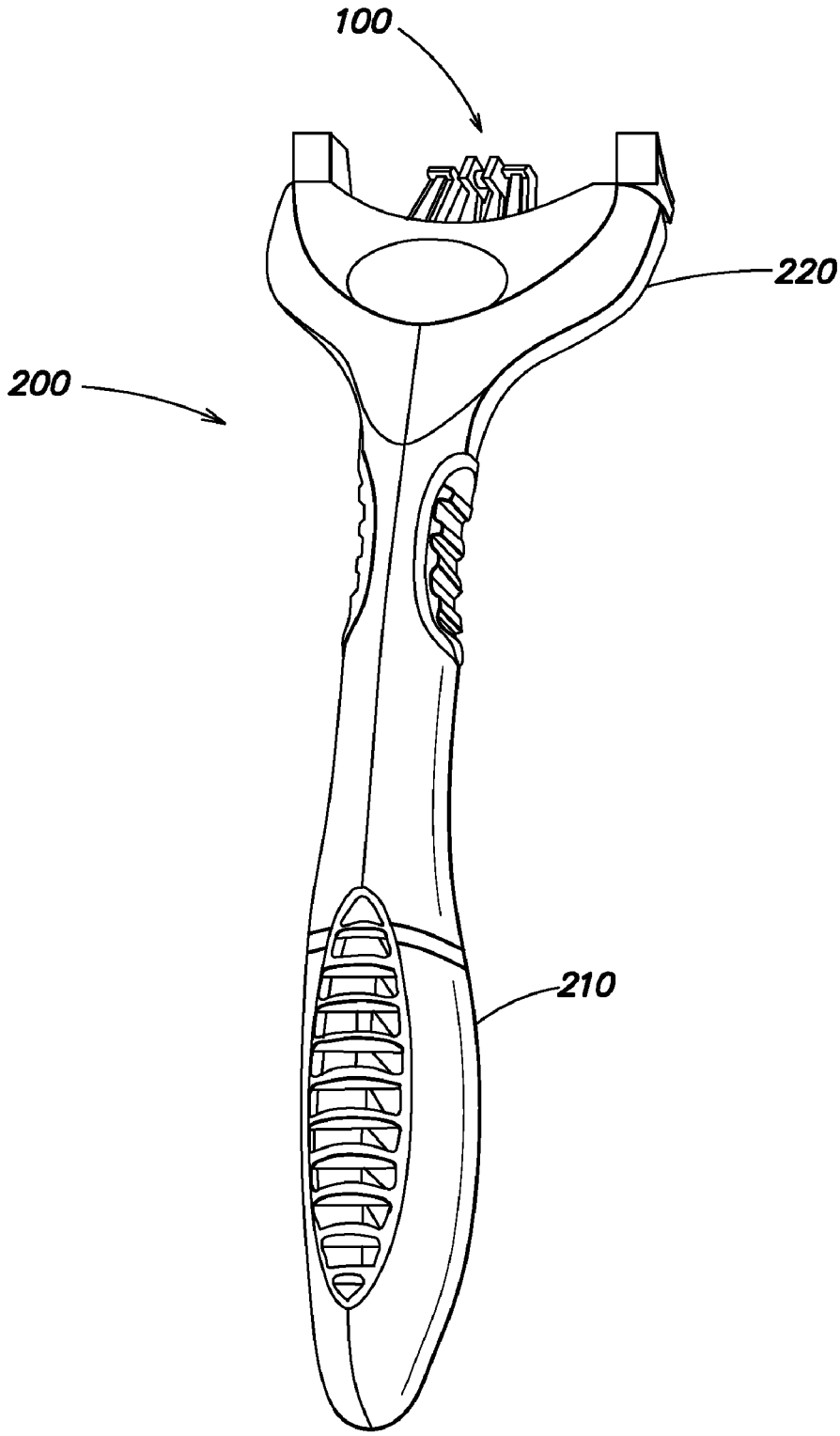
FIG. 3 is an isometric view from the rear of a razor handle of a third embodiment of the present invention.

Referring additionally now to FIG. 3 a razor handle 200 is shown that comprises an assembly of several component parts. The handle comprises a grip portion 210 and a head portion 220. The head portion has a pivot frame 100, as described above, disposed therein.

Figure 4A:
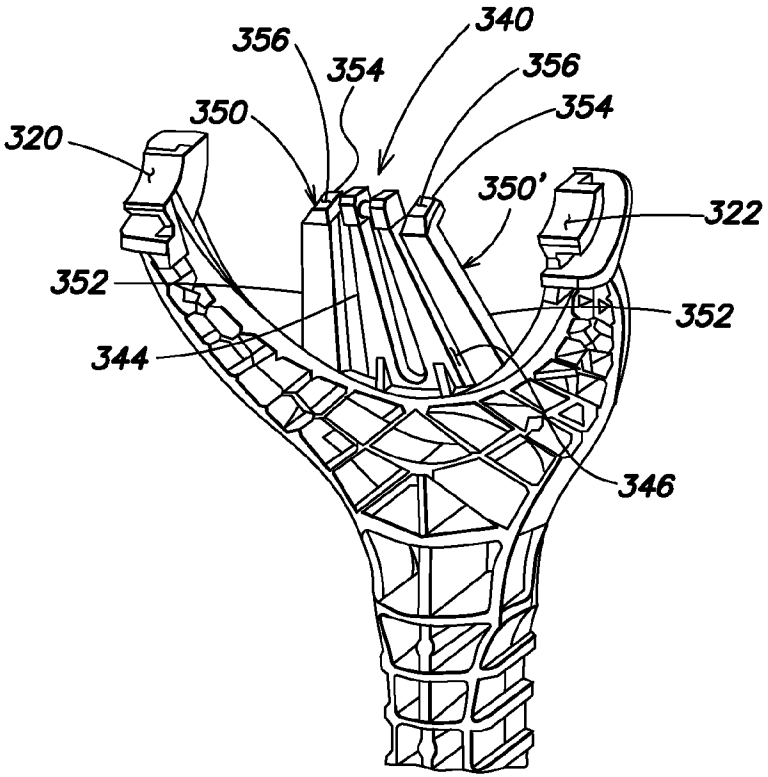
FIG. 4A is a partial isometric view from the front of the head portion of the fourth embodiment of the present invention.
Figure 4:
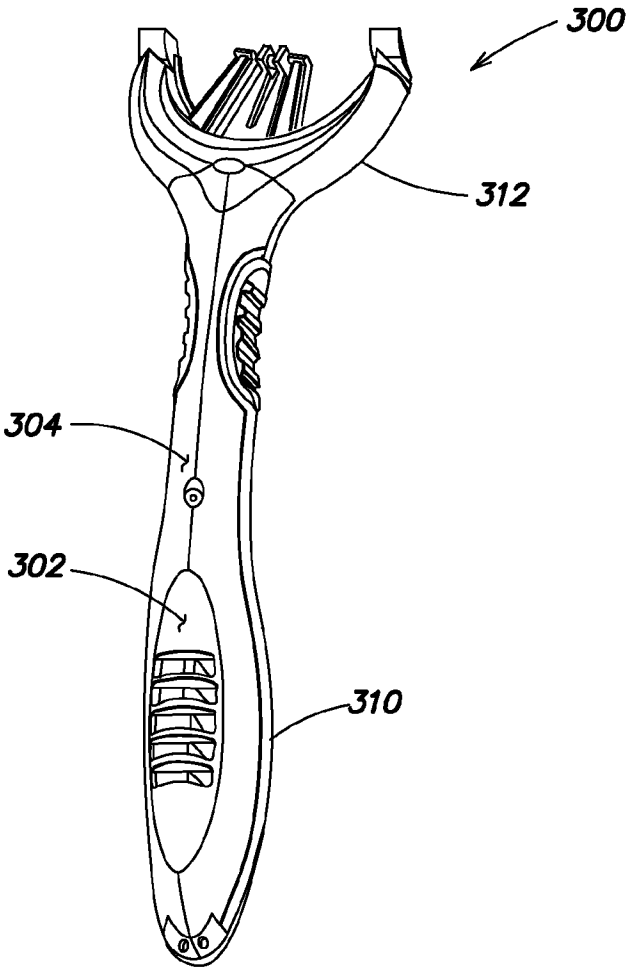
FIG. 4 is an isometric view from the rear of a razor handle of a fourth embodiment of the present invention.

Referring additionally now to FIGS. 4-7 and in particular FIGS. 4-4A, a razor handle 300 is shown that comprises a unitary molding. The razor handle 300 comprises a grip portion 310 and a head portion 312. The unitary molding of the handle comprises a first shot portion of a rigid material 302, preferably polypropylene and most preferably the grade designated AP5135-HS manufactured by the HUNTSMAN CO. as is described above. The handle comprises a second shot portion of a thermoplastic elastomeric material 304, that at least partially envelopes the first shot to provide enhanced hand gripping characteristics for a user, especially in a wet environment. The second shot can also provide an aesthetically pleasing appearance. The second shot is most preferably the thermoplastic elastomer (TPE) designated THERMOLAST KTF2ATL manufactured by the KRAIBURG CO. This particular TPE is selected based on a balance of several preferred characteristics including moldability; wet gripping characteristics and its ability to form a chemical bond to the polypropylene first shot at the interface between the polypropylene and TPE. This chemical bond satisfactorily bonds the second, TPE, shot on the first shot generally without the need for additional mechanical attachment means. The head portion 312 comprises, as previously described, pivoting connecting structure 320, 322, a biasing member 340 having side surfaces 344, 346 and creep control arms 350, 350' integrally formed with the head portion. Each creep control arm has a terminating surface 356 at the outer end thereof and has an elongated portion 352 and can have a foot 354 extending generally perpendicular to the elongated portion.

Figure 5:
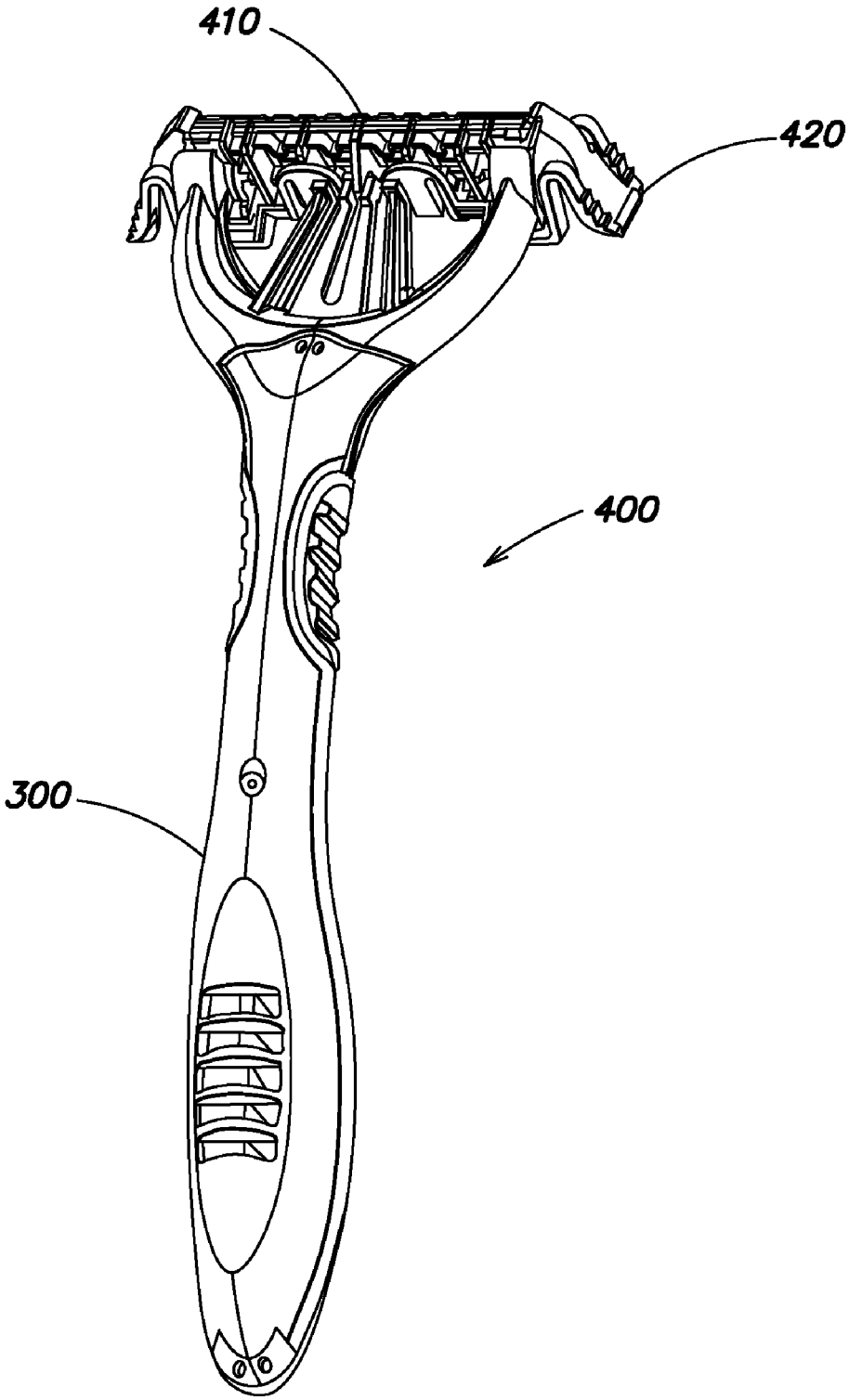
FIG. 5 is an isometric view from the rear of a safety razor of a fifth embodiment of the present invention.
Figure 6:
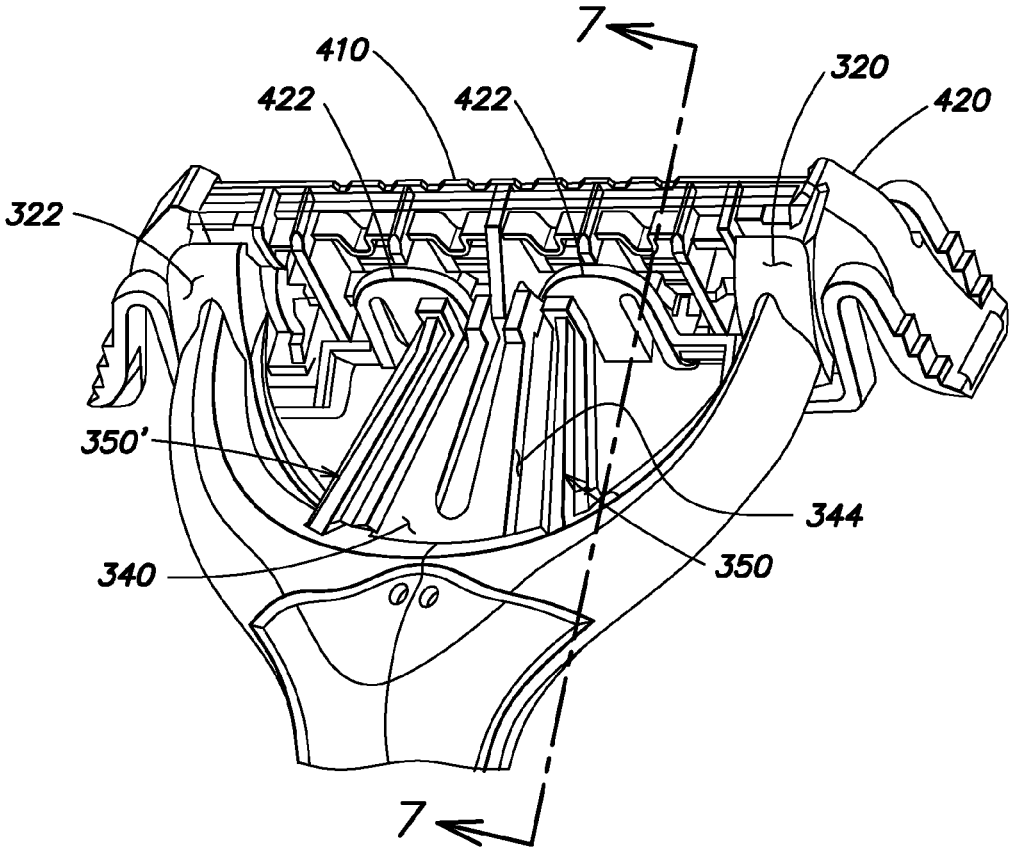
FIG. 6 is a detailed view of the head portion of the safety razor of FIG. 5.
Figure 7:
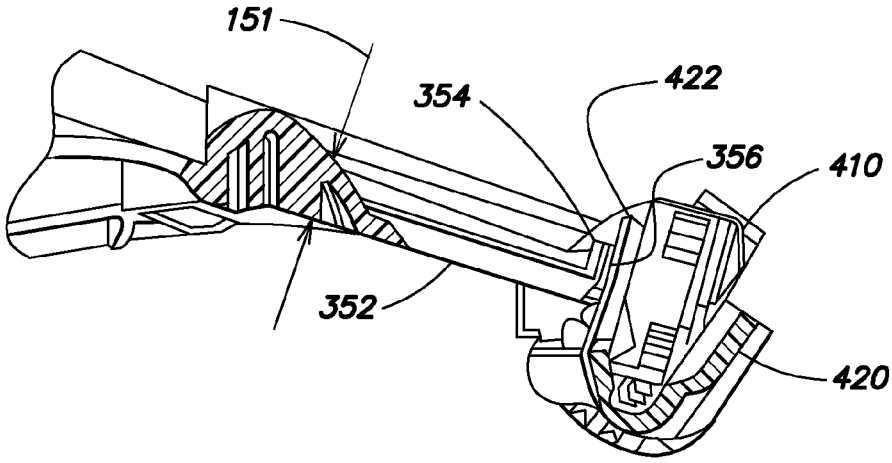
FIG. 7 is a partial sectional view on line 7-7 of FIG. 6.

Referring additionally now to FIGS. 5-7, a safety razor 400 is shown that comprises a handle 300 as previously described. The safety razor also comprises a razor cartridge 410 pivotally mounted to the pivoting connecting structure of the handle. The safety razor further comprises a protective cover 420 mounted to the cartridge, essential features and function of which are referenced in the Background section of the present application. The terminating surface 356 of the creep control arm abuts or is substantially adjacent an outer surface 422 of the protective cover and contact therebetween provides a first pivotal at-rest position of the razor cartridge relative to the handle and substantially resists pivotal movement of the razor cartridge away from this at rest position. In this first at-rest position, the cam surface of the biasing member is in contact with at least a first mating cam surface of the razor cartridge. When the protective cover 420 is removed, as for example when the razor is used for shaving, the contact between the cam surface of the biasing member and the cam surface of the cartridge causes the razor cartridge to adopt a second pivotal at-rest position. The biasing member also provides resilient movement of the razor cartridge away from the second at-rest position in response to forces encountered during shaving. The terminating surface 356 of the creep control arm is spaced sufficiently far from any portion of the cartridge 410 so that it does not interfere with the pivotal movement of the cartridge. The first at-rest position may be generally identical to the second at rest position or may be different. As described in the Background section of the present application, the creep resistance characteristics of polypropylene are inferior to those of POM. The time between the manufacture of individual components; bulk storage thereof; assembly and packaging of the components; shipment to and storage in a distribution center; shipment to and storage at a retail establishment; display at the retail establishment; purchase by a user to first use by the user can be considerable. A polypropylene biasing member can undergo creep in these circumstances. Creep is a permanent change of shape and thus creep of the biasing member can alter its spring characteristics and thus alter one or both of the second at-rest position or the resilient pivotal movement of the razor cartridge. The creep control arms act to securely restrain the cartridge in a pivotal orientation relative to the handle and thus restrain the biasing member through contact of the cam surfaces of the biasing member and cartridge. In the embodiment of the present invention where the first and second at-rest positions are generally identical, the biasing member is restrained in a position where it has zero or minimal stresses and thus creep in the biasing member is substantially prevented.

Figure 8:
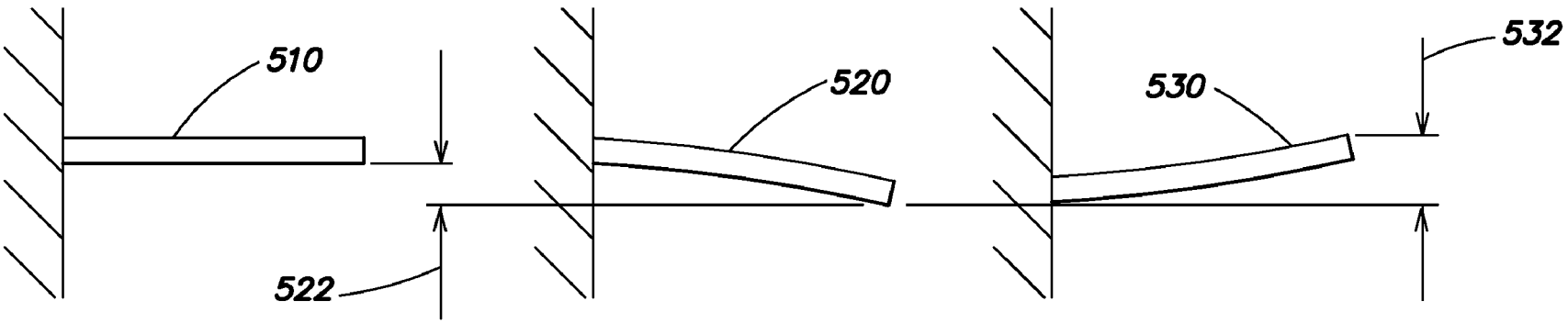
FIG. 8 is a diagrammatic representation of an embodiment of the present invention depicting diverse deflection modes.

In the embodiment of the present invention where the first and second at-rest positions are different, the biasing member can deliberately be held in an attitude where applied stresses can impart preferential creep to the biasing member so that the spring properties of the biasing member can be enhanced. This can provide increased resiliency of the pivotal movement of the cartridge or the spring properties of a smaller, thus less stiff, biasing member can be boosted to provide equivalent resiliency to a larger biasing member. This embodiment is represented in simplified diagrammatic form in FIG. 8. A leaf spring (shown in side view) has an undeflected position 510 and a working, deflected position 520 as, for instance, to provide resilient pivotal movement for the cartridge. One of skill in the art will understand the force required to deflect the leaf spring, and thus the reactive restoring force that can be applied to the cartridge, is proportional to the deflection dimension 522. If the leaf spring is permanently deformed to position 530 by deliberately inducing creep in the leaf spring, then the deflection 532 to the working position is greater and thus the force applied to the cartridge is proportionally greater for a leaf spring of equivalent size and material.

Furthermore, preferably at least a portion of the creep control arm 350 is adjacent at least a portion of a side surface 344, 346 of the biasing member. Preferably the creep control arm is spaced less than 3 mm from the side surface and more preferably less than 1.5 mm. In this manner the creep control arm provides a secondary function of preventing accidental damage to the biasing member during manufacture or bulk storage or handling of the handle from, for instance, contact with a second component. In this position, the creep control arm also substantially prevents a user from accidentally deflecting the biasing member with, for instance, her finger tip during use. Deflection of the biasing member independent of cartridge pivoting could remove contact of the cam surface of the biasing member with the cam surface of the housing, thereby preventing the biasing member from providing resilient pivoting movement of the cartridge in response to forces encountered during shaving.

Use of one or more creep control arms with the embodiments described herein enable a manufacturer to utilize a thermoplastic material having have less desirable creep resistance characteristics than POM. This provides manufacturing advantages without substantially affecting the desired resilient pivotal movement of a razor cartridge relative to a handle during shaving.

It is to be understood that the present invention is by no means limited to the particular construction herein disclosed and/or shown in the drawings, but also comprises any modifications or equivalents within the scope of the disclosure.

What is claimed is:

1. A wet shaving razor, comprising:

a handle having pivoting connecting structure, a creep control arm, and a biasing member; a razor cartridge pivotally mounted to the pivoting connecting structure; and a protective cover; wherein the creep control arm acts upon the protective cover to provide a first pivotal at-rest position of the cartridge relative to the handle; and wherein the biasing member acts upon the cartridge to provide a second pivotal at-rest position of the cartridge relative to the handle when the protective cover is removed.

2. The wet shaving razor of claim 1, wherein the creep control arm substantially resists pivotal movement of the razor cartridge relative to the handle away from the first at-rest position.

3. The wet shaving razor of claim 2, wherein the first at-rest position is substantially identical to the second at-rest position.

4. The wet shaving razor of claim 2, wherein the first at-rest position is different to the second at-rest position.

* * * * *